US006655069B2

(12) United States Patent
Kim

(10) Patent No.: US 6,655,069 B2
(45) Date of Patent: Dec. 2, 2003

(54) ACCESSORY MOUNTS FOR SHOTGUNS AND OTHER FIREARMS

(75) Inventor: Paul Y. Kim, Westminster, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 10/021,814

(22) Filed: Dec. 12, 2001

(65) Prior Publication Data

US 2003/0106251 A1 Jun. 12, 2003

(51) Int. Cl.[7] ..... F41G 1/34
(52) U.S. Cl. ..... 42/114; 42/115; 42/148
(58) Field of Search ..... 42/112, 114, 115, 42/116, 117, 143, 148

(56) References Cited

U.S. PATENT DOCUMENTS

| | | | | |
|---|---|---|---|---|
| 1,501,211 | A | * | 7/1924 | Forin |
| 2,128,936 | A | | 9/1938 | Green |
| 2,287,066 | A | | 6/1942 | Rogers |
| 2,402,086 | A | | 6/1946 | Rix |
| 2,826,848 | A | * | 3/1958 | Davies |
| 2,965,994 | A | | 12/1960 | Sullivan |
| 3,075,314 | A | | 1/1963 | Bakker |
| 3,090,150 | A | | 5/1963 | Stoner |
| 3,447,033 | A | * | 5/1969 | Redmond et al. |
| 3,513,581 | A | | 5/1970 | Slater |
| 3,857,323 | A | | 12/1974 | Ruger et al. |
| 4,087,930 | A | | 5/1978 | Grehl |
| 4,310,982 | A | | 1/1982 | Kast et al. |
| 4,536,982 | A | | 8/1985 | Bredbury et al. |
| 4,627,183 | A | | 12/1986 | Stuckman |
| 4,663,875 | A | | 5/1987 | Tatro |
| 4,733,489 | A | | 3/1988 | Kurak |
| 4,742,636 | A | | 5/1988 | Swan |
| 4,845,871 | A | | 7/1989 | Swan |
| 4,856,218 | A | | 8/1989 | Reynolds, Jr. |
| 4,941,277 | A | * | 7/1990 | Lawlor ..... 42/100 |
| 5,010,676 | A | | 4/1991 | Kennedy |
| 5,027,542 | A | * | 7/1991 | Simonetti ..... 42/72 |
| 5,033,219 | A | * | 7/1991 | Johnson et al. ..... 362/289 |
| 5,068,992 | A | * | 12/1991 | Velezis et al. ..... 42/73 |
| 5,092,071 | A | | 3/1992 | Moore |
| 5,111,587 | A | | 5/1992 | Plank |
| 5,142,806 | A | | 9/1992 | Swan |
| 5,198,600 | A | | 3/1993 | E'Nama |
| 5,201,135 | A | | 4/1993 | Cowles |
| 5,343,650 | A | | 9/1994 | Swan |
| 5,533,292 | A | | 7/1996 | Swan |
| 5,590,484 | A | | 1/1997 | Mooney et al. |
| 5,634,288 | A | | 6/1997 | Martel |
| 5,704,155 | A | | 1/1998 | Primeau, IV |
| 5,727,346 | A | | 3/1998 | Lazzarini et al. |
| 5,826,363 | A | * | 10/1998 | Olson ..... 42/75.01 |
| 6,012,374 | A | | 1/2000 | Brandl et al. |
| 6,374,528 | B1 | * | 4/2002 | Davis et al. ..... 42/71.01 |

OTHER PUBLICATIONS

United States Department of Defense, Military Standard: Dimensioning of Accessory Mounting Rail for Samll Arms Weapons, Feb. 3, 1995.

* cited by examiner

*Primary Examiner*—Stephen M. Johnson
(74) *Attorney, Agent, or Firm*—David Weiss

(57) ABSTRACT

Accessory mounts for firearms, including a combined handgrip and accessory mount for a shotgun, as well as detachably securable rails and modified Picatinny rails for mounting accessories to shotguns and other firearms.

18 Claims, 3 Drawing Sheets

ACCESSORY MOUNTS FOR SHOTGUNS AND OTHER FIREARMS

BACKGROUND OF THE INVENTION

This invention relates to accessory mounts for firearms, and more particularly to a combined handgrip and accessory mount for shotguns as well as to accessory mounts for other types of firearms.

Various types of devices are useful as accessories for being mounted to firearms, examples of such accessories being target illuminators and vertical pistol grips. Such accessories are conventionally mounted to an interface apparatus descriptively referred to as an accessory mount, which has been secured to the firearm. Such accessory mounts may include rail interface systems well known in the art pertaining to firearms, and in particular with respect to submachine guns, carbines, rifles and other firearms used for military and police operations.

SUMMARY OF THE INVENTION

The present invention provides further applications of and improvements to rail interface mounts for firearm accessories. According to one aspect of the present invention, there is provided a combined handgrip and accessory mount for a shotgun having a longitudinally moveable fore-end assembly, the handgrip/mount comprising: a shell adapted to be secured to the fore-end assembly for manually moving the fore-end assembly; and at least one rail structure on the shell for mounting a firearm accessory to the at least one rail structure. According to a preferred embodiment thereof, the shell includes interior arcuate sections for fitting the shell about a moveable fore-end tube of the shotgun's fore-end assembly, the shell adapted to be secured to the fore-end tube. The rail structures may include the well known Picatinny rail, although another aspect of the present invention is a modified version of the Picatinny rail in which the rail includes a channel longitudinally therealong, which channel includes a longitudinally extending wall having at least one aperture therethrough, and the shell is adapted for securing a firearm accessory to the shell through such aperture.

Another preferred embodiment of the combined handgrip and accessory mount for a shotgun, according to the present invention, comprises: a shell adapted to be secured to the shotgun's longitudinally moveable fore-end assembly, for manually moving the fore-end assembly; and at least one rail member adapted to be detachably secured to the shell for mounting a firearm accessory to the at least one rail member when the at least one rail member is secured to the shell. In a preferred embodiment thereof, the shell includes at least one longitudinal groove therealong, and the rail member includes a lateral projection longitudinally extending along the rail member for being received by the longitudinal groove when the rail member is secured to the shell. The longitudinal groove may comprise a longitudinally extending channel between two laterally outward projections longitudinally extending along the shell, and the lateral projection along the rail member projects laterally inwardly for being received by the channel of the shell. The handgrip/mount preferably includes two such longitudinal grooves or channels, each on opposite sides of the shell, for detachably securing two side rails to the shell for mounting a firearm accessory to one or each of the side rail members; in addition, the shell preferably includes a rail structure longitudinally extending along the shell's bottom for mounting a firearm accessory to the bottom rail structure.

The modified Picatinny rails of the present invention, as well as the provision of rail members which are detachably securable to the shell of the accessory mount, may be implemented in accessory mounts for shotguns as well as in accessory mounts for other firearms.

BRIEF DESCRIPTION OF THE DRAWINGS

The novel features believed to be characteristic of the invention, together with further advantages thereof, will be better understood from the following description considered in connection with the accompanying drawings in which preferred embodiments of the present invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
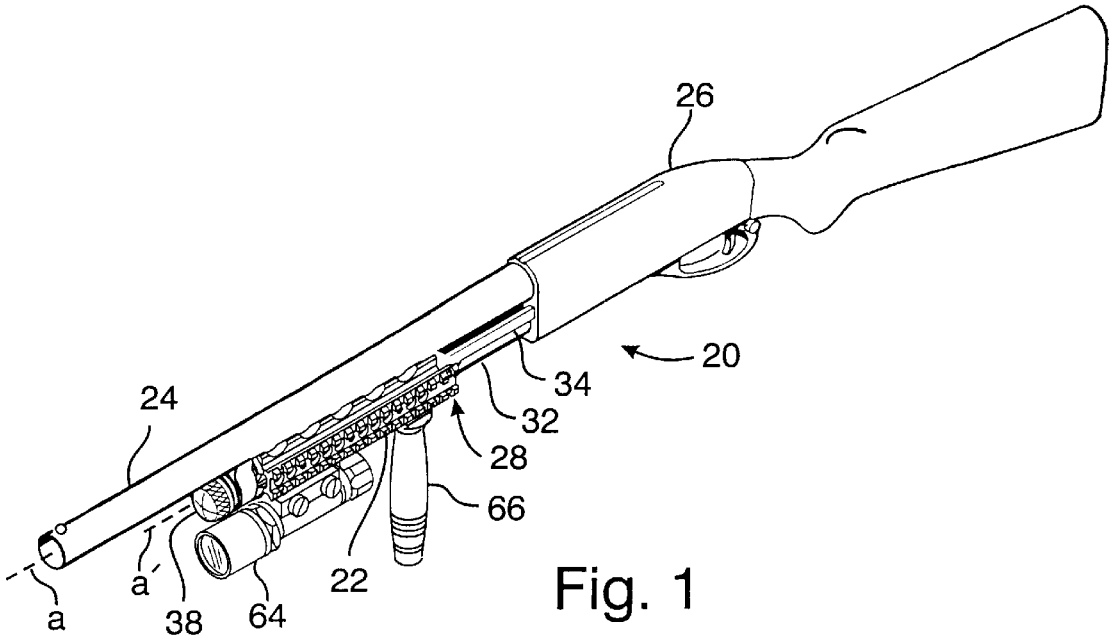
FIG. 1 is a perspective view of an example of a shotgun to which there is secured a preferred embodiment of an accessory mount according to the present invention, specifically a preferred embodiment of a combined handgrip and accessory mount.
Figures 2, 3, 4:
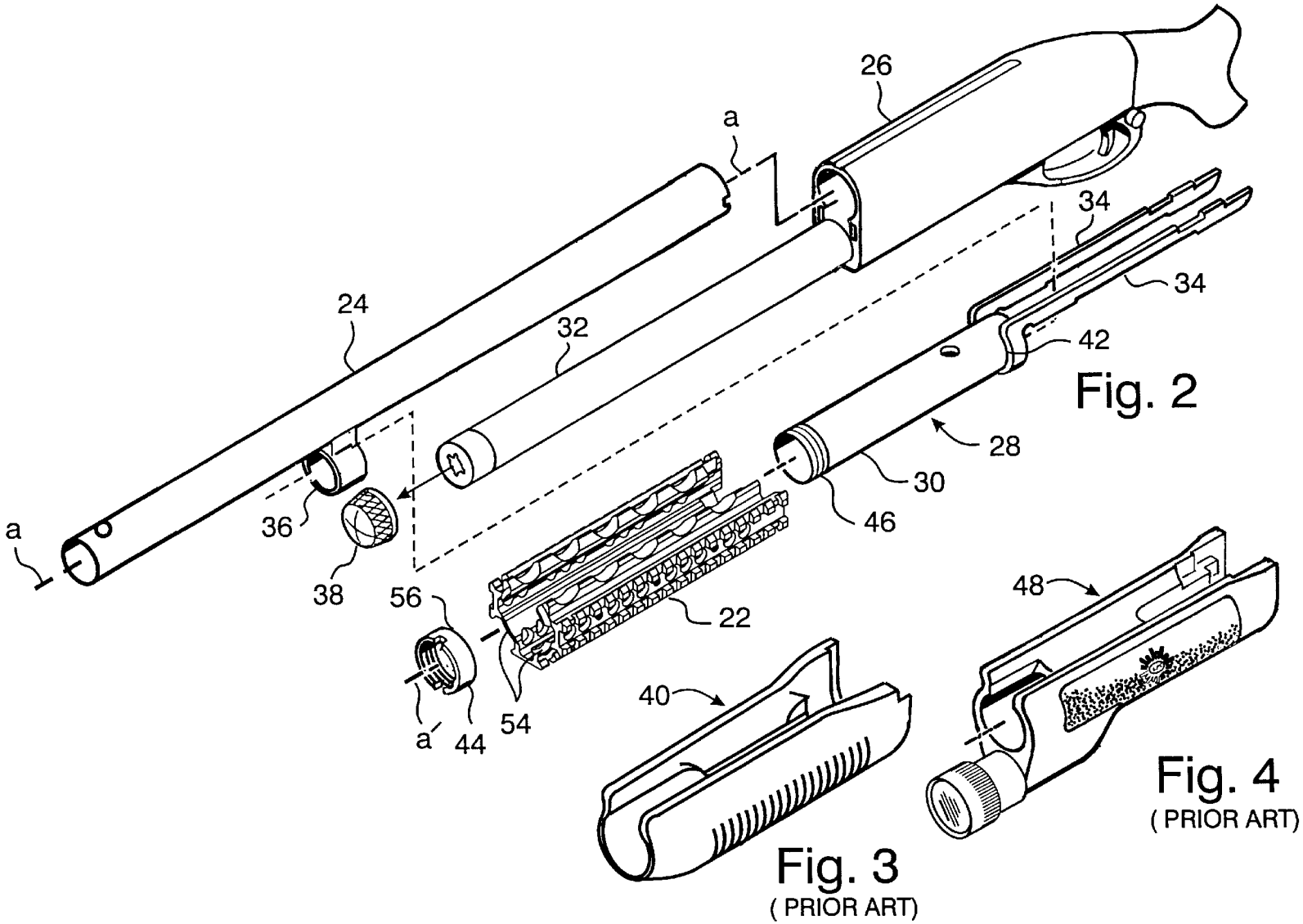
Fig. 3 (PRIOR ART)
Fig. 4 (PRIOR ART)
FIG. 2 is an exploded perspective view of parts of the shotgun and handgrip/mount embodiment of FIG. 1, in increased scale.
FIG. 3 is an example of a conventional handgrip for a shotgun that is replaced by the handgrip/mount embodiment of the present invention.
FIG. 4 is a prior art combined handgrip and target illuminator device for a shotgun.

Turning first to FIGS. 1 and 2, there is illustrated an example of a shotgun 20, such as a Remington Model 870 shotgun manufactured by Remington Arms Company, Inc. (of Madison, N.C.), equipped with a preferred embodiment of a combined handgrip and accessory mount 22 (or "handgrip/mount") in accordance with the present invention.

The shotgun 20 includes a barrel 24 extending along a longitudinal axis a from the shotgun's receiver 26. As is well known in the firearms art, the shotgun 20 further includes a fore-end assembly 28 including a fore-end tube 30 that is longitudinally moveable (i.e. moveable along a longitudinal axis a' generally parallel to the axis a) along a magazine tube 32. Dual action bars 34, projecting rearwardly from the fore-end tube 30, extend into the receiver 26 for actuating mechanisms for ejecting spent cartridges, chambering live cartridges and cocking the shotgun's hammer device.

The magazine tube 32 extends generally longitudinally from the receiver 26 and below the barrel 24, and a forward portion of the magazine tube 32 engages a barrel lug 36 and held thereto by a magazine cap 38.

It is also well known that such fore-end assemblies 28 have a handgrip secured to the fore-end tube 30, such as the conventional handgrip 40 shown in FIG. 3, for manually moving the fore-end tube 30 longitudinally along the magazine tube 34 upon which the fore-end tube 30 is slideably carried. Shotguns are ordinarily equipped with a conventional handgrip 40 when purchased, such handgrip 40 being secured to the fore-end tube 30 and against forward shoulders 42 of the action bars 34 by means of an internally threaded retainer nut 44 threadedly secured to the externally threaded forward end section 46 of the fore-end tube 30. As taught in U.S. Pat. No. 4,856,218 to Edward C. Reynolds, Jr., the conventional handgrip 40 may be replaced by a combined handgrip and target illuminator device 48, mounted on the fore-end tube 30 in the same manner as was the original equipment handgrip 40 and secured with the same retainer nut 44. U.S. Pat. No. 4,856,218 is incorporated herein by reference. Similarly, the handgrip/mount 22 of the present invention may replace and be substituted for the original equipment conventional handgrip 40, which handgrip/mount 22 may be secured to the movable fore-end tube 30 by the same retainer nut 44 as shown in FIGS. 1 and 2.

Turning to FIGS. 5–8, the preferred embodiment of the combined handgrip and accessory mount 22 includes a generally cylindrical shell 49 of greater than semi-circular cross-section, the shell 49 including interior arcuate surface sections 50 of a diameter slightly greater than the outside diameter of the shotgun's fore-end tube 30, for permitting the handgrip/mount 22 to be slip-fit about and carried by the fore-end tube 30. Near the rear end of the handgrip/mount 22, the sections 50 are recessed to provide rearwardly facing shoulders 52 for abutting the forwardly facing rear shoulders or stops 42 of the fore-end tube 30. At the front end of the handgrip/mount 22, the sections 50 terminate with a forwardly facing edge 54 (which may be forwardly inclined) for abutting the rearwardly facing edge 56 (which may be beveled) of the retainer nut 44 (see FIG. 2), when the handgrip/mount 22 is carried by the fore-end tube 30 with the handgrip/mount's rear shoulders 52 abutting the fore-end tube stops 42 while the retainer nut 44 is threaded upon the threaded forward end section 46 of the fore-end tube 30. The length of the handgrip/mount 22 between its rear shoulders 52 and its front edges 54 is such that the tightening of the retainer nut 44 causes the rear shoulders 52 to bear against the stops 42, thereby securing the handgrip/mount 22 to the fore-end tube 30.

Figure 5:
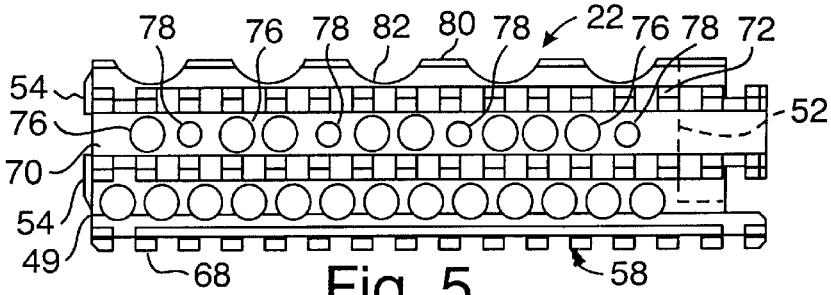
FIG. 5 is a side elevation view of the preferred embodiment of the handgrip/mount shown in FIGS. 1 and 2, in further increased scale.
Figure 6:
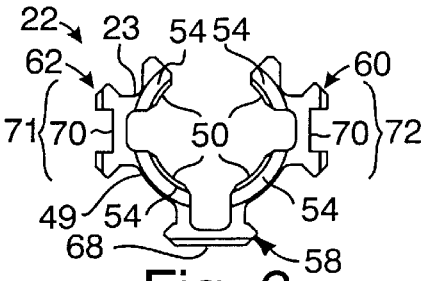
FIG. 6 is an elevation view of the front end of the handgrip/mount of FIG. 5.
Figure 8:
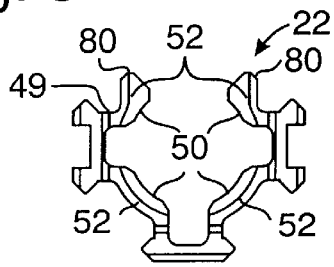
FIG. 8 is an elevation view of the rear end of the handgrip/mount of FIG. 5.

The preferred embodiment of the handgrip/mount 22 includes at least one longitudinal rail structure along the shell 49 (preferably along the entire length of the shell 49 as shown in FIGS. 5–14), such as a bottom rail structure 58 along the exterior underside thereof, and which also may include side rail structures 60, 62, to which may be mounted firearm accessories such as a target illuminator 64 and/or a vertical or pistol grip 66 as shown in FIG. 1, as well as other devices. Rails for accessory mounts are well known in the firearms art, for example as contained on rail interface system devices such as manufactured by Knight's Manufacturing Company (of Vero Beach, Fla.), including those disclosed in U.S. Pat. No. 5,826,363 to Douglas D. Olson, as well as those disclosed in U.S. Pat. No. 5,590,484 to Aurelius A. Mooney et al., both of which patents are incorporated herein by reference. One such prior art rail comprises a series of longitudinally spaced-apart ribs 68, such as specified in MIL-STD-1913 and commonly known as a Picatinny rail, which is shown in FIGS. 6 and 8 as comprising the bottom rail 58. Although such Picatinny rails may be used for the side rail structures 60, 62 as well, the preferred handgrip/mount 22 of the present invention includes a modified version of the Picatinny rail for the side rails 60, 62, which modified Picatinny rail may be used for the bottom rail 58 as well. The modified Picatinny rail of the present invention includes a slot or channel 70 longitudinally extending along each of the rails 60 and 62 through the ribs 72 and 74, such ribs being oriented perpendicular to the longitudinal axis a'. Either type of rail structure may be utilized for securing accessories having a Weaver style or other cooperating clamping device, although the provision of the channel 70 provides greater adaptability of accessory arrangement on a rail as well as additional types of securement opportunities. Further, the wall of each channel 70 may include apertures 76 therethrough, for weight and/or heat reducing purposes, as well as longitudinally spaced apart apertures 78 preferably with internal threads for securement of accessories by other securement devices (e.g. screws) instead of or in addition to securement by utilization of the rails 58, 60 and/or 62 alone. The top edges 80 of the handgrip/mount 22 may be provided with longitudinally spaced-apart concave notches 82 serving as finger grips as well as for providing weight and/or heat reduction.

The handgrip/mount 22 may be manufactured using fabrication methods well known in the art, of well known materials typically used in the art of making firearm accessory mounts including metals such as lightweight aluminum alloys and other rigid and durable materials such as polymeric materials.

When installing the handgrip/mount 22 on the shotgun 20 (see FIGS. 2 and 3), the user removes the magazine cap 38 from the magazine tube 32, forwardly moves or removes the barrel 24 so as to release the lug 36 from magazine tube 32, removes the retainer nut 44 from the threaded forward end section 46 of the fore-end tube 30, and removes the original equipment handgrip 40 from the fore-end tube 30. The user then slides the handgrip/mount 22 onto the fore-end tube 30 until its rearwardly facing shoulders 52 abut the stops 42; the retainer nut 44 is thereupon threaded onto the front end section 46 of the fore-end tube 30. The barrel 36 is reinstalled to the receiver 26 with the barrel lug 36 engaging the magazine tube 32, and the magazine cap 38 is replaced. The handgrip/mount 22 may be removed from the shotgun 20 by reversing the installation procedure and reinstalling the original equipment handgrip 40 if desired.

In use, the user grips the handgrip/mount 22 in the same manner that he/she would ordinarily grip the original equipment handgrip 40, for manipulating the fore-end tube 30 to longitudinally slide along the magazine tube 32 for causing the action bars 34 to perform their actuating functions.

The handgrip/mount 22 of the present invention has advantages over handgrips of the prior art in that a variety of commercially available firearm accessory devices such as target illuminators (for example, target illuminators marketed by Surefire, LLC, of Fountain Valley, Calif.) one example 64 of which is shown in FIG. 1, may be detachably mounted thereto in positions which are convenient to the user and which would not interfere with the function of the handgrip/mount 22 as a handgrip. The mounting thereto of a commercially available vertical or pistol grip (for example, vertical pistol grips marketed by Knight's Manufacturing Company, of Vero Beach, Fla., such as the example 66 shown in FIG. 1) provides additional advantage in facilitating the handgrip/mount 22 in its use as a handgrip for a shotgun, particularly since the pistol grip 66 may be adjustably positioned longitudinally along the handgrip/mount 22 as well as the ability for the pistol grip to be secured to the side rail in a horizontal position.

Figure 7:
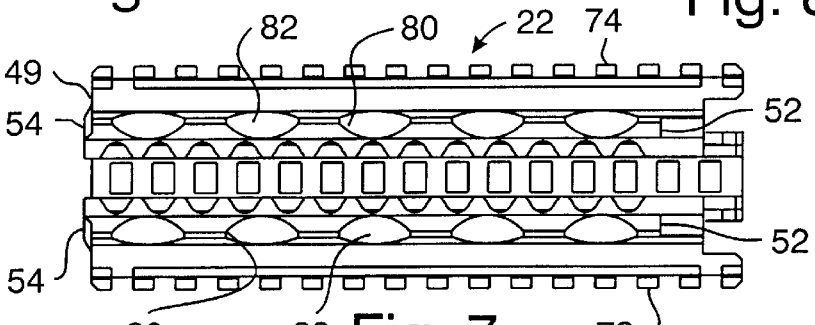
FIG. 7 is a top plan view of the handgrip/mount of FIG. 5.

The second preferred embodiment of a handgrip/mount 84 according to the present invention, shown in FIGS. 9–14—although the example shown is of a different length than the example of the first preferred embodiment 22 of FIGS. 5–8 for accommodating a fore-end tube 30 of shorter length—is similar in structure and operation to the first preferred embodiment 22 depicted in FIGS. 6–8 and described above, except as described below. Accordingly, like reference numerals are employed in FIGS. 9–14 for like components in FIGS. 6–8.

In the second preferred embodiment of the handgrip/mount 84, the side rails are removable from and attachable to the shell 85 of the handgrip/mount 84. Each of the two or opposite sides of the shell 85 includes a longitudinal groove preferably comprising two laterally outward projections 86 longitudinally extending along said shell 85, each pair of projections 86 separated by a longitudinally extending channel 88 including a wall 90 which, in the example of FIG. 10, is shown vertically disposed.

Figure 11:
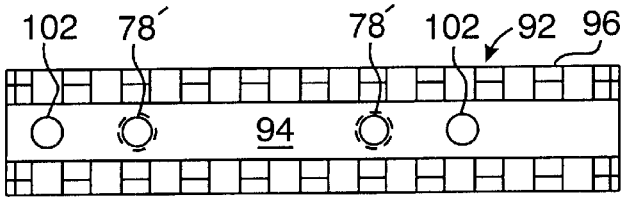
FIG. 11 is a side elevation view of a rail structure that may be detachably secured to the accessory mount of FIG. 9.
Figure 13:
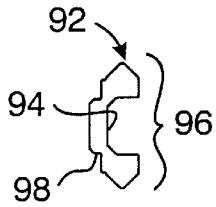
FIG. 13 is an elevation view of an end of the rail of FIG. 11.
Figure 12:
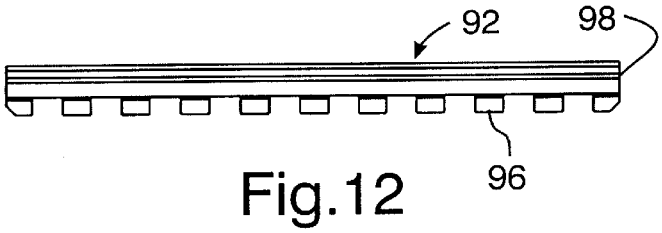
FIG. 12 is a top plan view of the detachably securable rail of FIG. 11.

A longitudinal rail member 92, shown in FIGS. 11–13, comprises a series of longitudinally spaced-apart ribs such as in a Picatinny rail, and preferably as in the modified Picatinny rail described above and which includes a slot or channel 94 (similar to the channel 70 of FIGS. 5 and 6) longitudinally extending through ribs 96 (similar to the ribs 72 or 74 of FIGS. 5 and 6). A laterally inward projection 98 longitudinally extending along said rail member 92 opposite the channel 94, is configured to be received by and mate with the groove or channel 88 between the pair of lateral projections 86 of the shell 85, and to be secured thereto such as by screws 100 (see FIG. 14) through apertures 102 through the projection 98 and threadedly engaging threaded apertures 104 in the wall 90 of the channel 88.

Figure 9:
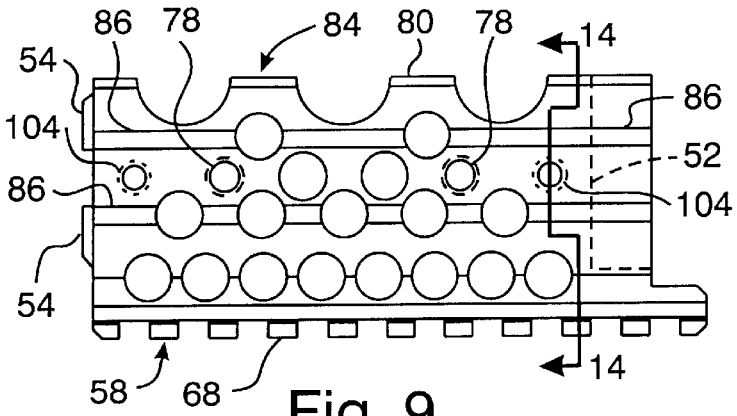
FIG. 9 is a side elevation view of a second preferred embodiment of an accessory mount for a firearm according to the present invention, specifically a second preferred embodiment of a combined handgrip and accessory mount for a shotgun, shown in further increased scale.
Figure 10:
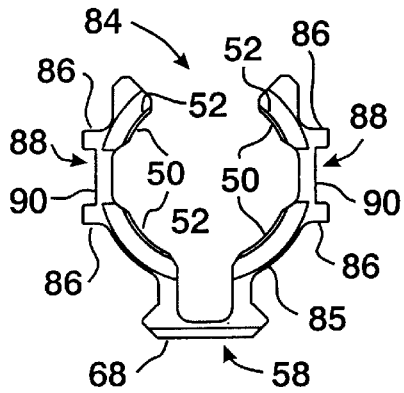
FIG. 10 is an elevation view of the front end of the accessory mount of FIG. 9.
Figure 14:
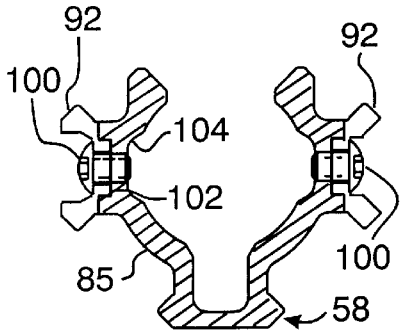
FIG. 14 is a cross-sectional view of the accessory mount of FIG. 9 taken along the line 14—14 in the direction of the appended arrows, shown with the rail of FIGS. 11–13 attached thereto.

The handgrip/mount 84 may be used without the rail members 92 secured thereto, as shown in FIGS. 9 and 10, in which case firearm accessories may be mounted to the lower rail structure 58, as well as to the channel walls 90 by utilization of the threaded apertures 78 in the shell 85. Alternatively, one or both of the side rail members 92 may be secured to the shell 85, as shown in FIG. 14, in which case firearm accessories may be mounted to the bottom rail structure 58 and/or the side rail members 92, as well as to the shell 85 by utilization of the threaded apertures 78 in the shell 85 communicating with apertures 78' in the side rail member 92 (which aperture 78' may also be threaded). The side rail members 92 may be detached from the handgrip/mount 84 by removing the screws 100, if desired.

It may be appreciated that the detachably securable rail members 92 may be used as well in a rail mount device for firearms other than in combination with a handgrip for a shotgun, which case such other rail mount device includes an accommodation securing the rail member 92 thereto, for example an accommodation for securably receiving the rail member 92 such as a longitudinal channel 88 in the mount for securably receiving a longitudinal projection 98 of the rail member 92.

Thus, there have been described preferred embodiments of accessory mounts for firearms, including a combined handgrip and accessory mount for a shotgun, as well as detachably securable rails and modified Picatinny rails for mounting accessories to shotguns and other firearms. Other embodiments of the present invention, and variations of the embodiment described herein, may be developed without departing from the essential characteristics thereof. Accordingly, the invention should be limited only by the scope of the claims listed below.

I claim:

1. Shotgun and accessory mount apparatus, comprising in combination:

a shotgun having a longitudinally moveable fore-end assembly;

a shell secured to said fore-end assembly for manually moving said fore-end assembly; and at least one longitudinal rail structure on said shell for mounting a firearm accessory to said shell in a longitudinally adjustable position therealong.

2. The apparatus according to claim 1, wherein:

said fore-end assembly includes a moveable fore-end tube; and said shell is fitted about and secured to said fore-end tube.

3. The apparatus according to claim 1, wherein:

said at least one rail structure includes a rail longitudinally extending along a bottom of said shell.

4. The apparatus according to claim 3, wherein:

said rail along said bottom of said shell comprises a Picatinny rail.

5. The apparatus according to claim 3, wherein:

said at least one rail structure includes a rail longitudinally extending along a side of said shell.

6. The apparatus according to claim 5, wherein:

said rail longitudinally extending along a side of said shell comprises a Picatinny rail.

7. The apparatus according to claim 1, wherein:

said at least one rail structure includes a longitudinal rail for mounting a firearm accessory to said rail and further includes a channel longitudinally along said rail.

8. The apparatus according to claim 7, wherein:

said channel includes a longitudinally extending wall having at least one aperture therethrough; and said shell is adapted for securing a firearm accessory thereto through said at least one aperture.

9. The apparatus according to claim 1, wherein:

said shell includes at least one longitudinally extending wall adapted for securing a firearm accessory thereto.

10. The apparatus according to claim 1, further including:

a pistol grip mounted to a one of said at least one rail structure.

11. The apparatus according to claim 1, including:

a target illuminator detachably mounted to a one of said at least one longitudinal rail structure.

12. Shotgun and accessory mount apparatus, comprising in combination:

a shotgun having a longitudinally moveable fore-end assembly;

a shell secured to said fore-end assembly for manually moving said fore-end assembly; and at least one rail structure on said shell for mounting a firearm accessory to said shell, said at least one rail structure longitudinally extending along substantially the entire length of said shell.

13. The apparatus according to claim 12, wherein:

said at least one rail structure includes a rail longitudinally extending along a bottom of said shell.

14. The apparatus according to claim 13, wherein:

said at least one rail structure includes a rail longitudinally extending along a side of said shell.

15. The apparatus according to claim 13, including:

a pistol grip detachably mounted to said rail longitudinally extending along the bottom of said shell.

16. The apparatus according to claim 12, including:

a target illuminator detachably mounted to a one of said at least one rail structure.

17. Shotgun and accessory mount apparatus, comprising in combination:

a shotgun having a longitudinally moveable fore-end assembly;

a shell secured to said fore-end assembly for manually moving said fore-end assembly;

at least one longitudinal rail structure on said shell; and a target illuminator detachably mounted to said at least one longitudinal rail structure.

18. The apparatus according to claim 17, including:

a pistol grip detachably mounted to a one of said at least one longitudinal rail structure.

* * * * *